United States Patent [19]

Stanescu

[11] Patent Number: 4,971,168

[45] Date of Patent: Nov. 20, 1990

[54] BOAT SIDE-LADDER

[76] Inventor: Georgel V. Stanescu, v.le Calatajimi 36, 50137 Florence, Italy

[21] Appl. No.: 328,636

[22] Filed: Mar. 27, 1989

[30] Foreign Application Priority Data

Apr. 1, 1988 [IT] Italy ..... 9375 A/88

[51] Int. Cl.[5] ..... E06C 9/00

[52] U.S. Cl. ..... 182/1; 182/84; 182/86

[58] Field of Search ..... 182/1, 84, 86, 106; 114/362

[56] References Cited

U.S. PATENT DOCUMENTS

| | | | |
|---|---|---|---|
| 501,694 | 7/1893 | Richards | 182/1 |
| 784,832 | 3/1905 | Bracegirdle | 114/362 X |
| 3,856,110 | 12/1974 | Nilsson | 182/84 |
| 4,363,150 | 12/1982 | Nilsson | 182/84 X |
| 4,669,574 | 6/1987 | Moutot | 182/106 X |

FOREIGN PATENT DOCUMENTS

| | | | |
|---|---|---|---|
| 730004 | 3/1966 | Canada | 182/84 |
| 1135326 | 8/1962 | Fed. Rep. of Germany | 182/84 |
| 2037355 | 7/1980 | United Kingdom | 114/362 |

*Primary Examiner*—Karen J. Chotkowski

*Attorney, Agent, or Firm*—McGlew and Tuttle

[57] ABSTRACT

The side ladder has upper and lower footpaces (1, 3) connected with side elements (5) on which a flight of steps (7) is hinged. A first actuator (11) is provided for withdrawing the ladder from a housing (15) on the boat and a second actuator (13) is provided for rotating the ladder about a horizontal axis. A leverage (21, 23, 27, 29) keeps the steps (7) and the lower footpace (3) in their horizontal position during rotation of the ladder. A piston and cylinder system (53) is provided for operating a handrail (41) and a further rotation of the ladder about a vertical axis can be carried out by a hydraulic motor (31).

13 Claims, 3 Drawing Sheets

BOAT SIDE-LADDER

DESCRIPTION

The invention relates to a ladder for embarking and disembarking passengers on and from boats, said ladder being able to be housed within a housing provided in the boat, and comprising at least a landing, i.e. a footpace, a flight of steps and a second landing or footpace.

There are known ladders of this type which are housed within a suitable space in the bulwark of the boat and which may perform several movements in order to be disposed in the operative position. These movements are frequently at least partially carried out manually.

The object of the invention is a ladder of the above mentioned type, which is provided with a large number of positioning movements which are all driven automatically by suitable actuator means.

This and other objects, which will become apparent to those skilled in the art by reading the following description are obtained with a ladder for embarking and disembarking on and from a boat, which in its inoperative position is housed in a housing on the boat to which said ladder is combined, comprising: a first upper footpace; a second lower footpace; at least one side element connecting said upper footpace to said lower footpace, said side element being hinged to said upper and lower footpace; a flight of steps hinged to a leverage which keeps said steps and the lower footpace in a horizontal position while the ladder moves from a horizontal to an inclined position, said leverage being hinged to said side elements and to said footpace; first actuator means for withdrawing said ladder from its inoperative position; and second actuator means for varying the inclination of said ladder.

The housing may be formed in the bulwark of the boat, and said first actuator combined to said first footpace is able to cause the rotation of the ladder about an axis which is about parallel to the deck and the side of the boat. However, said housing can be formed also about parallel to the deck, and about perpendicular to the side of said boat, for example, below the deck surface. In a further possible embodiment, the housing can be parallel to the deck and to the side of said boat.

Advantageously, the ladder may further comprise a handrail carried by posts hinged to said handrail and to the structure of the ladder, and may also comprise an actuator for the lifting into operative position and the lowering into inoperative position of said handrail. Moreover, a further actuator may be combined to the first footpace for the rotation of said footpace about an axis which is about perpendicular to the footpace, which actuator may be carried by a frame connected to said first actuator, said axis being carried by the said frame.

The drawing shows schematically a non-limiting example of the invention.

The ladder according to the invention comprises: an upper footpace 1 and a lower footpace 3; side elements, i.e. sides, 5 disposed between the two footpaces 1 and 3; and a plurality of steps 7 hinged to said sides in a manner to be described below.

Figure 2:
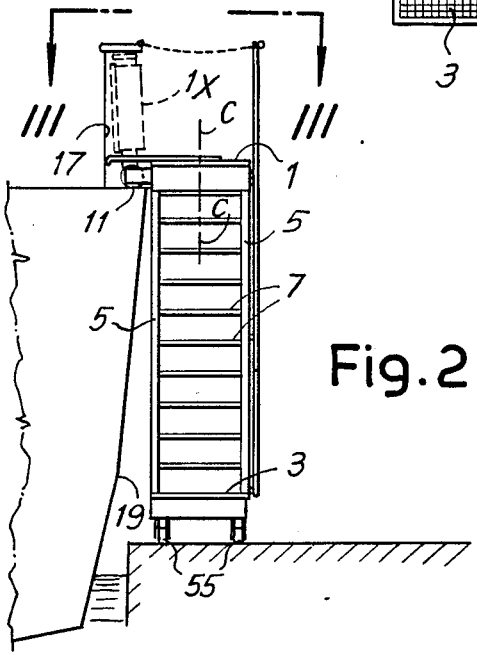
FIG. 2 shows a view according to line II—II of FIG. 1.
Figure 4:
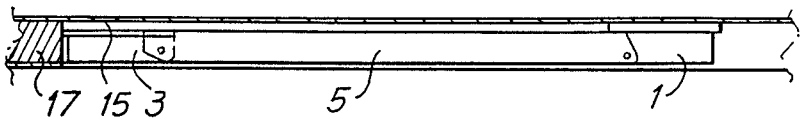
FIG. 4 shows a top view of the ladder in its inoperative position.

The upper footpace 1 is carried by a frame 9 comprising two arms 9A, 9B rotating about an axis A—A by means of an actuator 11 which has a high torque. The operation of the actuator 11 causes the overturning of footpace 1 from a horizontal operative position to an almost vertical inoperative position in which the ladder is housed within a housing 15 in the bulwark 17 of the hull 19 of the boat to which said ladder is combined. The inoperative position is illustrated by dashed lines in FIG. 2. The footpace 1 is pivotally supported by the frame about an axis C—C which is perpendicular to the said footpace. To cause the rotation of footpace 1, and thus of the whole ladder about axis C—C, there is provided a hydraulic motor 31 or similar means carried by frame 9, which motor drives, for example through a worm drive, the rotation of a pinion 33 which is in meshing engagement with a portion of a gear 35 having internal toothing, and which is below footpace 1 and solid thereto. Thus, the rotation of pinion 33 causes the rotation about axis C—C of the whole footpace and of the whole ladder with respect to frame 9. To allow the rotation about axis C—C, an edge of footpace 1 has a curved shape and further the box structure making up said footpace is provided with a large opening to allow the passage of arms 9A, 9B of frame 9.

Figure 1:
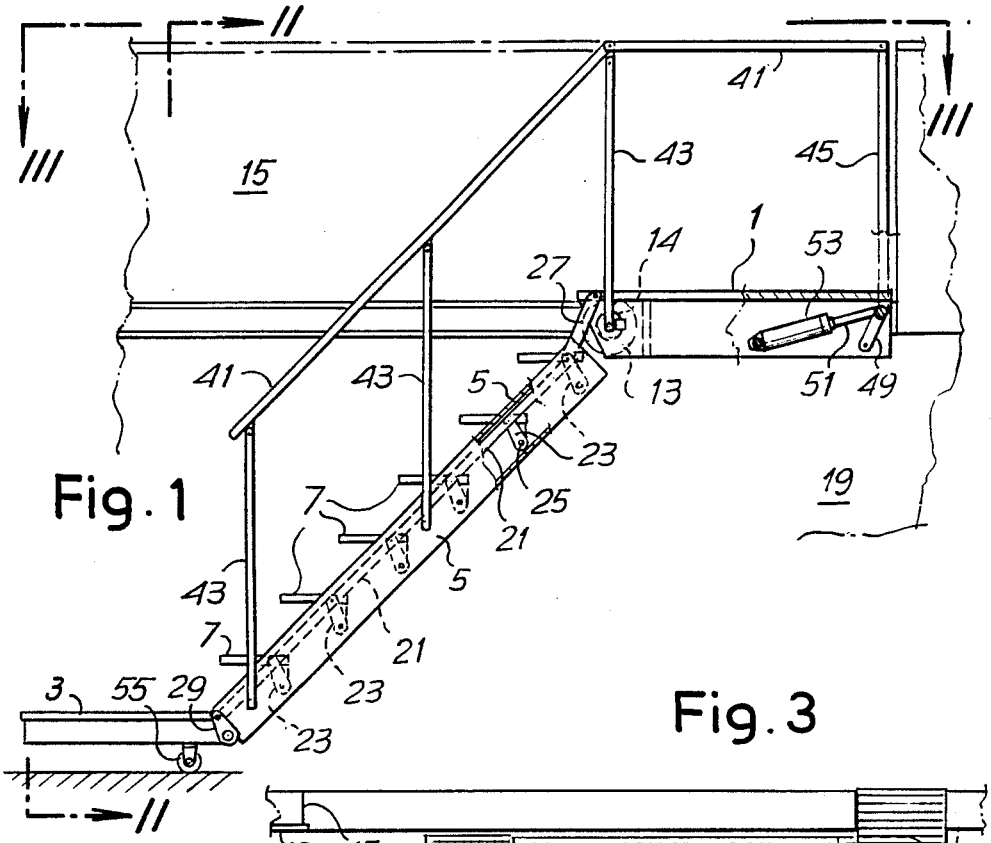
FIG. 1 shows a view of the ladder in operative position placed in side-by-side relationship with the hull.
Figure 5:
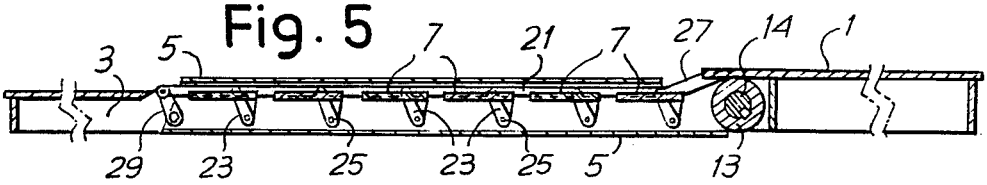
FIGS. 5 and 6 show a section on line V—V and a side view according to line VI—VI of FIG. 7.
Figure 9:
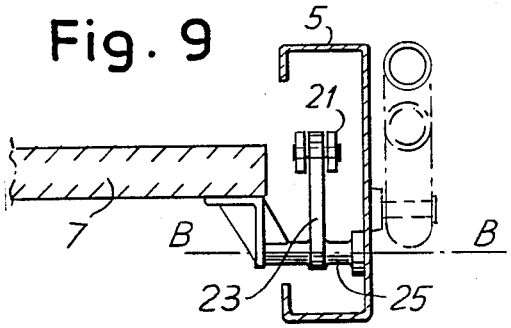
FIG. 9 shows in sectional view a detail of the side.

Inside footpace 1 there is housed a further actuator 13 which drives the lifting and lowering movements of sides 5 which carry the steps 7, and of footpace 3. These movements are obtained by rotation of shaft 14 of actuator 13, which causes the solid rotation of the ladder sides 5. Actuator 13 allows the lifting of the flight of steps 7 from the position in which it is inclined at about 45° up to the horizontal position, as can be seen respectively in FIG. 1 and FIG. 5. During this rotation, platform 3 and steps 7 must be kept in horizontal position so as to allow the use of the ladder at any inclination between 0° and 45°. To this end, for each side 5, or for only one single side, a leverage is provided comprising a tension rod 21 hinged at various points to a plurality of connecting rods 23 (one for each step) each of which is in turn hinged at 25 (FIGS. 1 and 9) to the corresponding side 5, so as to oscillate about an axis B—B. FIG. 9 shows a detail of a connecting rod 23 and relevent step 7. Another connecting rod 27 links said tension rod 21 to the upper footpace 1, while a connecting rod 29 links it to the lower footpace 3.

The leverage 21, 23, 25, 27, 29 ensures the horizontal positioning of platform 3 and steps 7 during rotation of sides 5 when the ladder moves from a horizontal position into an inclined position. In this way, the ladder may be used at any intermediate inclination and, furthermore, in an inoperative condition, the steps 7 and lower footpace 3 are into alignment with sides 5, taking up a position of minimum overall dimensions, so that housing 17 provided in the bulwark of the boat can have very reduced dimensions.

The ladder according to the invention is further provided with a handrail 41 hinged to a first end of three posts 43 which are hinged, on their opposite ends, to the corresponding side 5. The handrail is hinged to a further post 45 which is solid at 47 to a first end of a connecting rod 49 which is in turn hinged to footpace 1 and to the end of a stem 51 of a cylinder-piston system 53. Said cylinder-piston system 53 drives into rotation the connecting rod 49 thus drives the lifting and lowering of handrail 41.

The lower footpace 3 may be provided with a pair of pivoting wheels 55 which rest on the pier when the ladder is used on a landing wharf.

Figure 6:
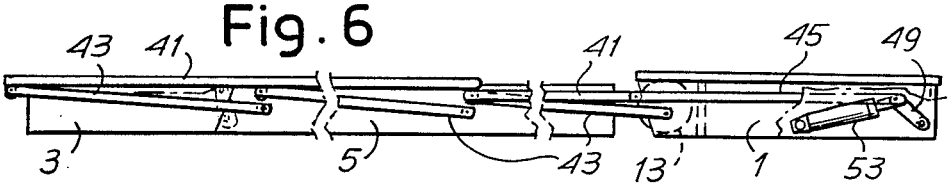
Figure 7:
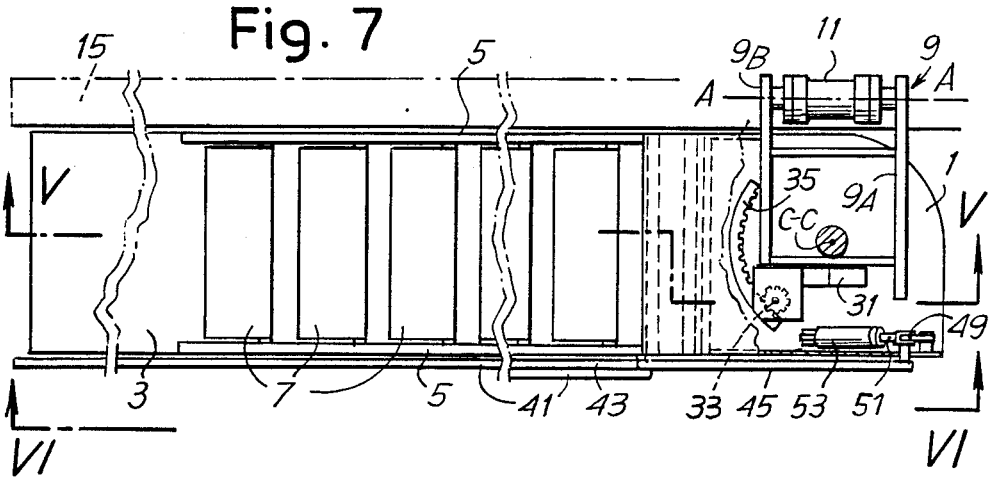
FIG. 7 shows a plan view of the ladder in its horizontal lifted position and with parts taken away.
Figure 8:
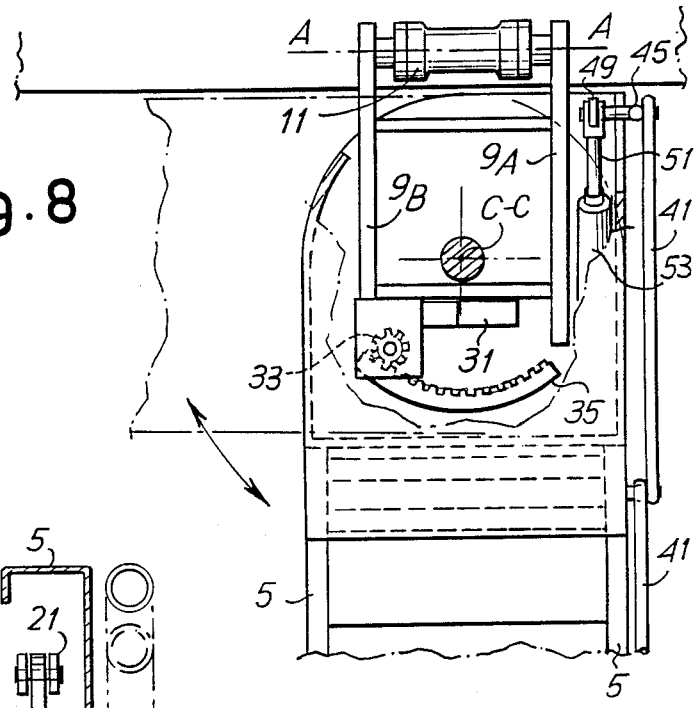
FIG. 8 shows a view similar to FIG. 7 in which the ladder is in a different position.

The working of the ladder is as follows. In inoperative condition the ladder is housed in the bulwark of the boat, as indicated by dashed lines in FIG. 2, and is maintained in this position by suitable locks, not shown, controlled by hydraulic systems or the like. By operating the actuator 11, the ladder is rotated through about 90° to be placed in the horizontal position shown by FIGS. 5 and 6, in which it is disposed side-by-side with respect to the hull of the boat and in its lifted position. Actuator 13 causes the inclination of the sides 5 and thus the lowering of the ladder down to the necessary extent. During this lowering, the leverage housed into sides 5 maintains steps 7 and platform 3 in horizontal position all the time. It is therefore possible to stop the lowering of the ladder at any desired position and use it in that condition. At the end of the lowering, the cylinder-piston system 53 is operated for the lifting of the handrail. A reversal of the described operations causes the reintroduction of the ladder into housing 17 within the bulwark.

Figure 3:
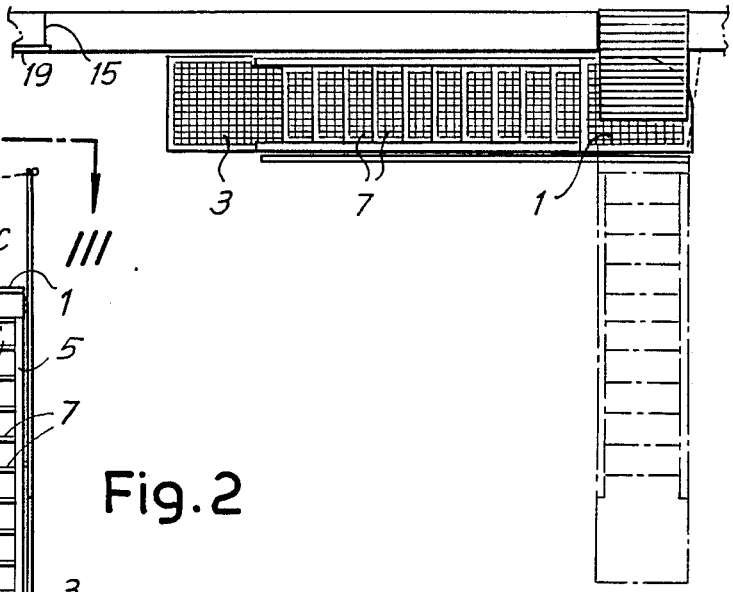
FIG. 3 shows a top view according to line III—III of FIGS. 1 and 2.

When the ladder is used on a landing wharf, the pivoting wheels 55 allow the ladder to follow the movements of the boat without undergoing any damage. Moreover, the hydraulic motor 31 allows a rotation of the ladder with respect to frame 9 about the axis C—C, so that the same ladder can be disposed in the position shown by dashed lines in FIG. 3, i.e. perpendicular to the hull.

When the ladder is in operative position on a landing wharf, actuators 11 and 13, which may advantageously be hydraulic actuators, can be released to allow the ladder to follow the movements of the hull to which it is connected.

Figure 10:
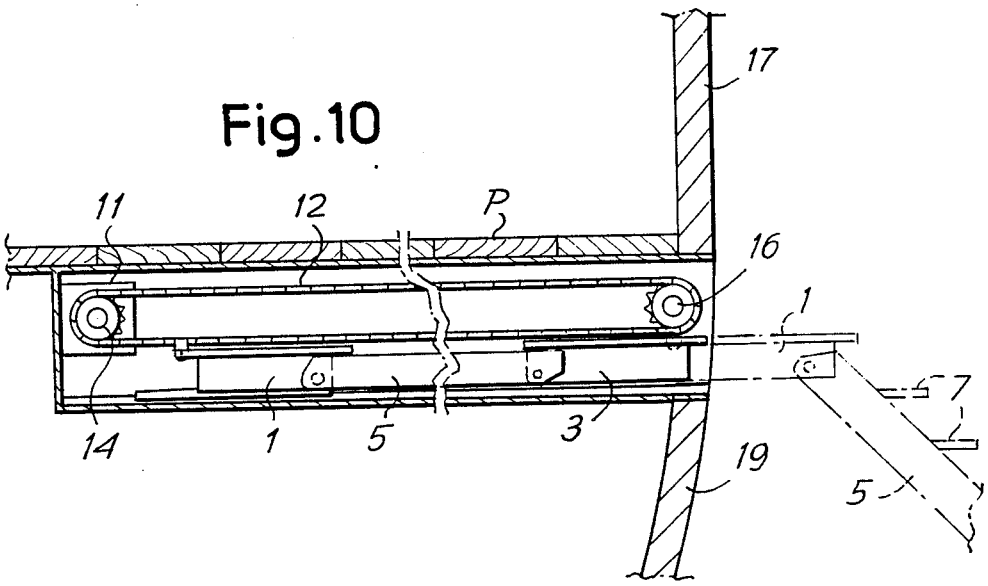
FIG. 10 shows, in a partial section according to a plane perpendicular to the longitudinal axis of the boat, a modified embodiment of the invention.

FIG. 10 shows a modified embodiment of the housing for the accomodation of the ladder when the latter is in its inoperative condition. In this embodiment, the housing 55 is disposed parallel to the boat deck P (below or above the latter) and the ladder is pulled out in a direction approximately perpendicular to the flank of the hull. For the withdrawal and the introduction of the ladder from and into housing 55 an actuator is provided, again indicated by 11, having a piston or, as in the example of the drawing, a gear 14 able to drive a chain 12 which is connected, at an intermediate position thereof, to the footpace 1 of the ladder and suitably driven by a second gear 16 located in housing 55.

The drawings show by way of example only one embodiment of the invention, which can take the form of a variety of embodiments and arrangements without, nevertheless, departing from the scope of protection conferred by the claims.

I claim:

1. A ladder for embarking on and disembarking from a boat, the ladder being of the type which, in an inoperative position, is housed extending in straight condition along the boat, adjacent the deck and in vertical plane, comprising:

a first, upper footpace;

a second, lower footpace;

at least one side element connecting said upper footpace to said lower footpace, hinge means connecting said at least one side element to said upper and said lower footpace;

a flight of steps and a leverage, hinge means connecting said flight of steps and said leverage, said leverage keeping all individual steps of said flight of steps and said lower footpace in a horizontal position during movement of the ladder from a horizontal to an inclined position, further hinge means linking said leverage to said at least one side element and to said upper and lower footpace;

first actuator means connected by a frame to said upper footpace, said first actuator means controlling movement of the upper footpace around a first axis parallel to the footpace and the side of the boat from between a vertical, inoperative and a horizontal operative position; and second actuator means connected by a frame to said upper footpace and disposed at the hinge means linking the upper footpace and said at least one side element, for varying the inclination of the ladder by rotating the ladder around a second axis parallel to the footpace and substantially perpendicular to said first axis.

2. Ladder according to claim 1, further comprising a handrail carried by posts hinged to said handrail and to the structure of the ladder, and lifting actuator means for lifting said handrail into an erect, operative position and lowering said handrail into a collapsed, inoperative position.

3. Ladder according to claim 1, wherein a further actuator means is combined to said first, upper footpace for the rotation of the first, upper footpace about a vertical axis which is approximately perpendicular to the said first, upper footpace.

4. Ladder according to claim 3, wherein said further actuator means is carried by the frame connected to said first actuator means, said vertical axis being carried by said frame.

5. Ladder according to claim 3, wherein said actuator means are hydraulically operated actuators.

6. Ladder according to claim 1, wherein said first actuator means and said second actuator means are releasable when the ladder is in an operative condition.

7. A ladder for embarking on and disembarking from a boat, which in the operative position is housed in a housing on the boat to which said ladder is combined, comprising:

a first, upper footpace;

a second, lower footpace;

at least one side element connecting said upper footpace to said lower footpace, hinge means connecting said at least one side element to said upper and said lower footpace;

a flight of steps and a leverage, hinge means connecting said flight of steps and said leverage, said leverage keeping all individual steps of said flight of steps and said lower footpace in a horizontal position during movement of the ladder from a horizontal to an inclined position, further hinge means linking said leverage to said at least one side element and to said upper and lower footpace;

first actuator means connected by a frame to said upper footpace, said first actuator means controlling movement of the upper footpace around a first axis parallel to the footpace and the side of the boat from between a vertical, inoperative and a horizontal, operative position; and second actuator means supported by said ladder and disposed at the hinge means linking the upper footpace and said at least one side element, for varying the inclination of the ladder by rotating the ladder around a second axis parallel to the footpace and substantially perpendicular to said first axis; and third actuator means supported by said upper footpace for rotating the ladder around a vertical axis perpendicular to the upper footpace.

8. A ladder according to claim 7, further comprising a handrail carried by posts hinged to said handrail and to the structure of the ladder, and lifting actuator means for lifting said handrail into an erect, operative position and lowering said handrail into a collapsed, inoperative position.

9. A ladder according to claim 7, wherein a further actuator means is combined with said first, upper footpace for rotation of the first, upper footpace about an axis which is approximately perpendicular to the said footpace.

10. A ladder according to claim 9, wherein said further actuator means is carried by the frame connected to said first actuator means, said vertical axis being carried by said frame.

11. A ladder according to claim 9, wherein said actuator means are hydraulically operated actuators.

12. A ladder according to claim 7, wherein said first actuator means and said second actuator means are releasable when the ladder is in an operative condition.

13. A ladder for embarking on and disembarking from a boat, which in the operative position is housed in a housing on the boat with which said ladder is combined, comprising:

a first, upper footpace;

a second, lower footpace;

at least one side element connecting said upper footpace to said lower footpace, hinge means connecting said at least one side element to said upper and said lower footpace;

a flight of steps and a leverage, hinge means connecting said flight of steps and said leverage, said leverage keeping all individual steps of said flight of steps and said lower footpace in a horizontal position during movement of the ladder from a horizontal to an inclined position, further hinge means linking said leverage to said at least one side element and to said upper and lower footpace;

first actuator means connected by a frame to said upper footpace, said first actuator means controlling movement of the upper footpace around a first axis parallel to the footpace and the side of the boat from between a vertical, inoperative and a horizontal, operative position; and second actuator means supported by said ladder and disposed at the hinge means linking the upper footpace and said at least one side element, for varying the inclination of the ladder by rotating the ladder around a second axis parallel to the footpace and substantially perpendicular to said first axis; and third actuator means combined with said first footpace for the rotation of the first footpace about an axis which is approximately perpendicular to the first footpace, said third actuator means being carried by the frame connected to said first actuator means, and said vertical axis being carried by said frame.

* * * * *